US005344358A

United States Patent [19]

Jantzen

[11] Patent Number: 5,344,358

[45] Date of Patent: Sep. 6, 1994

[54] DOLL HAVING EMBOSSIBLE FABRIC AND EMBOSSING TOOL

[75] Inventor: Ellen E. Jantzen, El Segundo, Calif.

[73] Assignee: Mattel, Inc., El Segundo, Calif.

[21] Appl. No.: 71,092

[22] Filed: Jun. 4, 1993

[51] Int. Cl.[5] ..... A63H 3/36

[52] U.S. Cl. ..... 446/268; 446/98; 446/491; 434/82; 2/243.1; 101/3.1

[58] Field of Search ..... 446/268, 385, 98, 374, 446/491, 321, 474, 424, 86; 2/243 A; 434/81, 82

[56] References Cited

U.S. PATENT DOCUMENTS

| | | | |
|---|---|---|---|
| 2,005,719 | 6/1935 | Hayden | 434/81 X |
| 2,944,368 | 7/1960 | O'Brian et al. | 446/98 |
| 3,234,681 | 2/1966 | De Lucia | 446/86 X |
| 3,236,007 | 2/1966 | Abeson | 446/374 |
| 3,293,796 | 12/1966 | Strader | 446/374 |
| 3,783,554 | 1/1974 | Shapero | 446/374 |
| 3,834,065 | 9/1974 | Glass et al. | 446/268 |
| 4,261,133 | 4/1981 | Hanson et al. | 446/424 X |

FOREIGN PATENT DOCUMENTS

| | | | |
|---|---|---|---|
| 619702 | 5/1961 | Canada | 446/321 |

*Primary Examiner*—Mickey Yu
*Attorney, Agent, or Firm*—Roy A. Ekstrand

[57] ABSTRACT

A doll includes a dress having at least a portion thereof formed of a multi-layered embossible fabric having a malleable layer such as metal foil or the like together with one or more soft flexible layers such as cloth fabric bonded together to form a readily formable and crimpable fabric. An embossing tool used in combination with the doll and the embossible fabric includes a pair of movable jaws hingedly coupled each defining a corresponding embossing raised portion and mating recess on the inwardly facing portions thereof. The embossing tool is applied to the embossible fabric and used to impart a plurality of raised or recessed embossed designs upon the fabric. The malleable character of the foil layer together with the softness and flexible of the fabric layer permit the embossed designs to be removed by simple smoothing of the fabric for repeated use. Embodiments are shown in which a pair of fabric layers are secured to each side of a malleable foil layer as well as a single soft layer secured to a malleable foil layer formed either as a fabric material or a sprayed on particulate material.

15 Claims, 1 Drawing Sheet

12
11
14
13
21
10
20
22
31
32
41
23
30
42
40
43

45
41
44
43
35
40
46
42
47

5
22
41
40
34
36
30
42
43
5

30
36
34
22
41
40

52
22
41
51
50
42
47
45
40
46
44
43

63
61
60
62

DOLL HAVING EMBOSSIBLE FABRIC AND EMBOSSING TOOL

FIELD OF THE INVENTION

This invention relates generally to dolls and toy figures and particularly to the clothing and accessory items used in combination therewith.

BACKGROUND OF THE INVENTION

Dolls and toy figures have enjoyed long term extended popularity among children of a wide age group and continue to be a strong group of product lines for most toy manufacturers. Because of the great and extending popularity of dolls and toy figures, a virtually endless variety of dolls and toy figures have been created by practitioners in the art through the years. The dolls and toy figures have been provided in human resembling figures, fantasy-type figures including cartoon and other fictional characters as well as animal-like figures which generally resemble fanciful animals such as teddy bears or the like. In addition, toy figures generally described as action figures have also been provided in a variety of appearances generally characterized by exaggerated human-like appearances representing characters such as warriors, heroes, villains or the like.

In many dolls and toy figures, the clothing or apparel or other associated fabric accessories of the doll or toy figure form an essential component in the entertainment and amusement provided by the doll or toy figure. For example, dolls having removable clothing which the child user may "dress" in a variety of fashion items and combining accessories are quite common in the marketplace. One of the more popular types of such dolls or toy figures are often referred to as fashion dolls in which elaborate and often exotic clothing is provided. A similar type of doll or toy figure generally referred to as fantasy dolls is provided with clothing is best described as costuming and provides the doll with a well recognized or highly fantasized appearance such as a ghost or fairy godmother or other recognizable character. In such clothing article related type dolls, very extended wardrobes are often available to provide numerous clothing changes.

U.S. Pat. No. 2,944,368 issued to O'Brian, et al. sets forth TOY DOLL STRUCTURES in which a human-like doll figure is independently supported by a base member and a plurality of clothing articles are formed of a resilient material such as plastic and are elastically deformable to be fitted upon the doll body in a snap-fit or resilient attachment. The clothing articles are preferably formed of a sheet of resilient thermoplastic material or the like and may be imprinted with clothing appearance or designs.

U.S. Pat. No. 3,783,554 issued to Shapero sets forth APPLIABLE DOLL DECORATIONS in which a doll construction kit enables a child to mold a three-dimensional doll and decorate it with preprinted labels such that the doll has an attractive appearance similar to that of a doll wholly constructed at a factory. Preprinted labels defining clothing and facial and hair features are provided for application to a molded doll. The labels are constructed of a rubber-like material which facilitates the stretching of the labels when applied to a contoured doll surface to eliminate wrinkles.

U.S. Pat. No. 3,293,796 issued to Strader sets forth a FORMABLE SHEET HAVING PILE FABRIC SECURED TO BOTH SURFACES in which a flexible simulated animal hide is bonded to a malleable metal foil liner to provide a moldable or formable animal hide. This moldable or formable animal hide is then applied to a basic animal figure and formed to correspond to the animal body and secure the animal hide to the toy animal figure.

While the foregoing prior art devices referred to and described above have provided a substantial degree of enjoyment and amusement for a wide variety of child users, there remains nonetheless a continuing need in the art for evermore interesting and improved toy figures and dolls.

SUMMARY OF THE INVENTION

Accordingly, it is a general object of the present invention to provide an improved doll or toy figure. It is a more particular object of the present invention to provide an improved doll or toy figure in which an interesting and novel play pattern is available to the child user to further enhance the value of the doll or toy figure.

In accordance with the present invention, there is provided for use in combination with a doll having a body to which clothing or accessories may be secured, apparatus comprises: an embossible article securable to the body and having a malleable layer and at least one flexible layer commonly joined to form a composite material; and an embossing tool having mating portions for embossing a predetermined design upon the embossible article.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
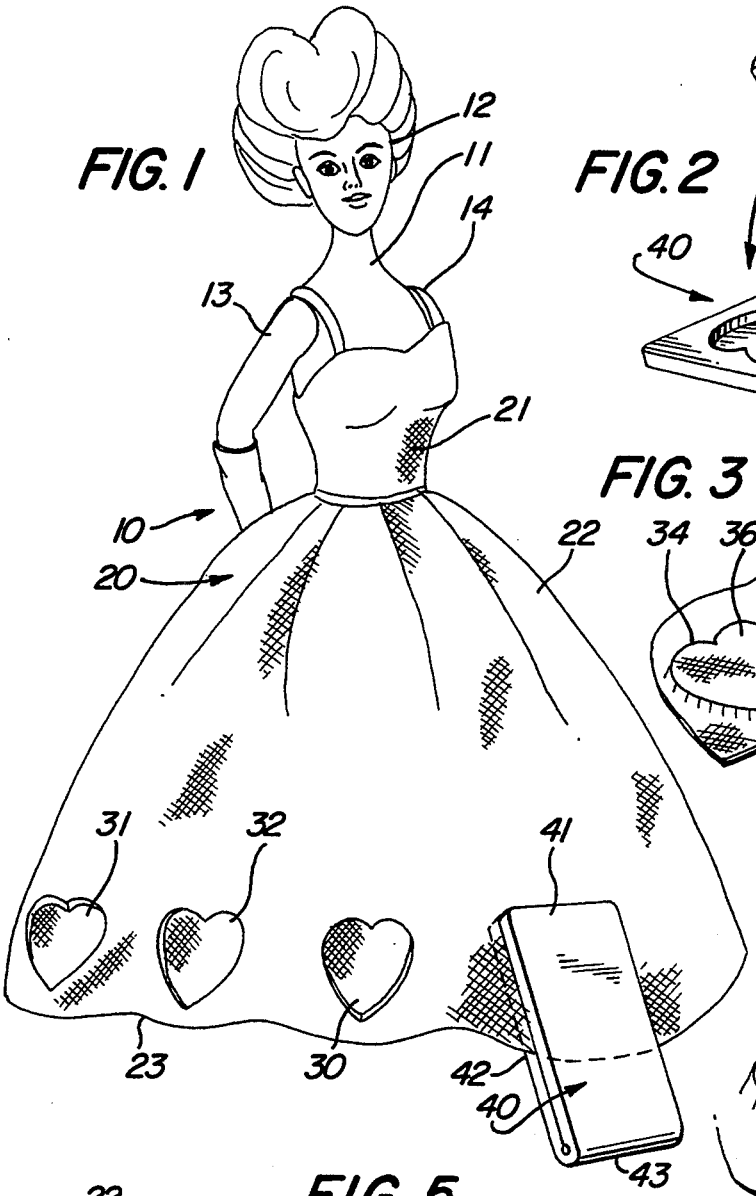
FIG. 1 sets forth a perspective view of a doll having embossible fabric and embossing tool constructed in accordance with the present invention.

FIG. 1 sets forth a perspective view of a doll having embossible fabric and embossing tool constructed in accordance with the present invention and generally referenced by numeral 10. Doll 10 defines a body portion 11, a head 12 and a pair of arms 13 and 14 fabricated in accordance with conventional fabrication techniques. A dress 20 constructed in accordance with the present invention defines a bodice portion 21 and a skirt 22. Skirt 22 defines a hem-line 23 fabricated of a multi-layer material lamination described below in greater detail. However, suffice it to note here that skirt 22 is formed of a fabric combining at least one malleable or formable material layer such as metal foil together with at least one soft fabric layer such as cloth fabric or the like.

In accordance with an important aspect of the present invention set forth and described below in greater detail, an embossing tool generally referenced by numeral 40 is formed of a pair of generally planar jaw portions 41 and 42 pivotally secured at a resilient hinge portion 43. In its preferred form, jaws 41 and 42 and hinge 43 are integrally formed of a single molded plastic member in which hinge 43 forms a so-called "living hinge" or similar molded hinge structure. In further accordance with the present invention, embossing tool 40 is utilized to form a plurality of embossed designs 30, 31 and 32 at desired locations upon skirt 22. The structure of embossing tool 40 is set forth below in greater detail. However, suffice it to note here that embossing tool 40 supports a raised portion upon the inner surface of jaw 41 and a correspondingly shaped recessed portion upon the inner surface of jaw portion 42 which cooperate to emboss designs 30 through 32 upon skirt 22. It should be noted that embossing tool 40 is operable in either of two positions to produce either a raised embossed design such as design 30 or a recessed embossed design such as designs 31 and 32 upon skirt 22. In accordance with the present invention, the provision of a fabric material composition for skirt 22 which includes a malleable or formable layer such as a metal foil layer causes the material of skirt 22 to be readily formable and thus embossed designs such as designs 30 through 32 once formed by tool 40 remain formed in skirt 22.

It will be apparent to those skilled in the art that a virtually endless variety of embossed design shapes and sizes may be utilized in practicing the present invention. Thus, while heart-shaped designs are shown for example in the present invention, the present invention is by no means limited to any particular design shape. It is well within the contemplation of the present invention that other designs such as names, symbols, corrugations or the like may be used in the manner in which embossing tool 40 is utilized without departing from the spirit and scope of the present invention. It should be equally apparent to those skilled in the art that while the embossible fabric of the present invention is used to form skirt 22 of dress 20, the present invention is readily applicable to other clothing and accessory articles used in a similar manner to provide the present invention doll with a variety of embossible and crimpable clothing and accessory articles which may be used to further enhance the play value of the present invention doll.

It will be apparent to those skilled in the art that while the preferred embodiment set forth in FIG. 1 utilizes a doll body to support the embossible material, the present invention applies equally well to other types of toy figures. As a result, it should be understood that the use of the term doll or toy figure in the descriptions set forth herein are generally interchangeable and thus the terms doll or toy figure may be considered interchangeable. For purposes of simplicity and clarity, the term doll will often be utilized in the descriptions and claims herein to embrace toy figures and dolls in a general sense.

Figure 2:
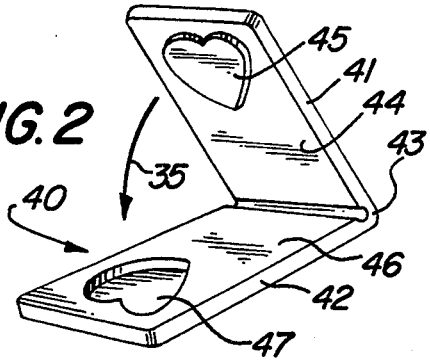
FIG. 2 sets forth a perspective view of the embossing tool of the present invention in the open position.

FIG. 2 sets forth a perspective view of embossing tool 40 in the open position normally assumed by embossing tool 40 in the absence of a closing force during the embossing process. As described above, embossing tool 40 is formed of a pair of generally planar jaws 41 and 42 joined at a preferably resilient hinge portion 43. Jaw 41 defines an interior planar surface 44 which in turn defines an extending raised portion 45. Correspondingly, jaw 42 defines a planar surface 46 having formed therein a recess portion 47. In accordance with the embossing function of embossing tool 40, recess portion 47 is correspondingly shaped to raised portion 45 and is slightly larger permitting raised portion 45 to be received within recess portion 47 when jaws 41 and 42 are closed in the direction indicated by arrow 35.

Figure 3:
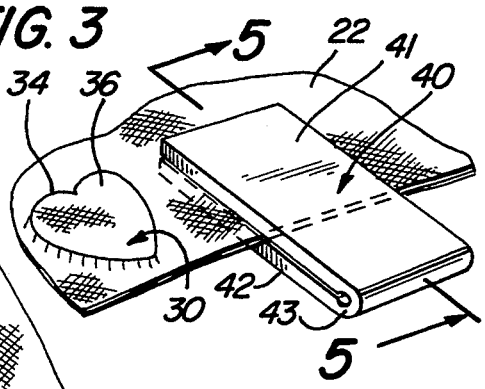
FIG. 3 sets forth a partial perspective view of the embossing tool and embossible fabric of the present invention in a closed position.

FIG. 3 sets forth a partial perspective view of skirt 22 and embossing tool 40 performing the above-described embossing process. A raised design 30 having a shape corresponding to raised portion 45 and recess portion 47 is shown formed within skirt 22 having been so formed as jaws 41 and 42 are pressed tightly together from opposite sides of skirt 22. The result is the creation of a raised design 30 having a generally planar surface 36 and a formed portion 34 about the periphery of surface 36. In accordance with the present invention, raised design 30 remains embossed in skirt 22 once embossing tool 40 is removed. For purposes of further illustration, embossing tool 40 is shown positioned upon skirt 22 in the closed position in which a second raised design identical to raised design 30 or recessed design 31 (seen in FIG. 1) is formed as jaws 41 and 42 are brought together to emboss skirt 22.

Figure 4:
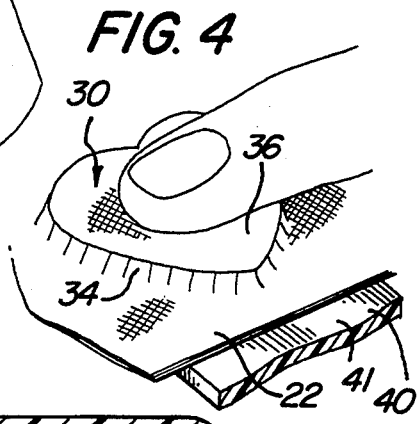
FIG. 4 sets forth a perspective view of an embossed portion of the present invention doll and embossible fabric being smoothed out or returned to normal.

FIG. 4 sets forth a partial perspective view of skirt 22 having a raised design 30 embossed thereon formed by pressing skirt 22 against one side of embossing tool 40 such that raised portion 45 forms design 30. Thus, it will be apparent that a "one-sided" embossing object or tool may be used. As described above, raised design 30 includes a generally planar surface 36 having a shape corresponding to the raised portion and recess portion of embossing tool 40 (seen in FIG. 2). As is also described above, raised design 30 further defines a formed portion 34 about the periphery of surface 36 which has been formed in accordance with the above-described embossing process. In the operation shown in FIG. 4, the user has placed a finger upon raised design 30 and is in the process of removing raised design 30 and returning the embossed portion of skirt 22 to its original or unembossed configuration. The malleable character of the fabric combination of skirt 22 permits the user to simply smooth out embossed design 30 by pressing skirt 22 and particularly raise design 30 against a convenient surface while stroking the surface of skirt 22 in a smoothing or flattening manipulation. Once again, the malleable character of the fabric provided to skirt 22 by the malleable foil material layer permits this straightening or smoothing to impart a flat nonembossed appearance to skirt 22 which is retained leaving the fabric in its original appearance. In addition to fabric shaping using embossing tools, the embossible fabric may be shaped by hand and/or pressed about a shaping object such as a ball, coin or other object.

Figure 5:
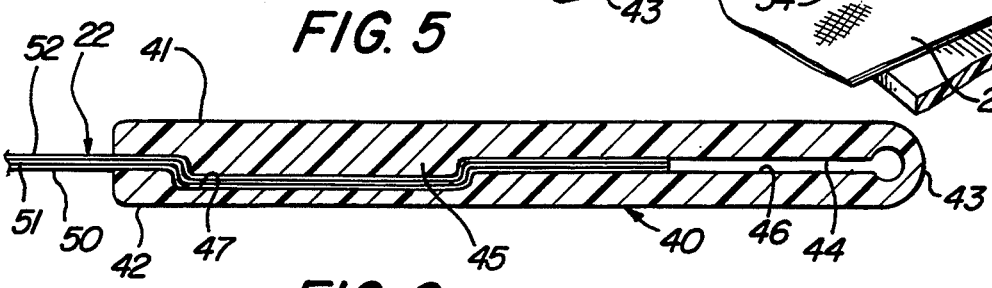
FIG. 5 sets forth a section view of the tool and embossible fabric of the present invention taken along section lines 5—5 in FIG. 3.

FIG. 5 sets forth a section view of embossing tool 40 and skirt 22 during the embossing process taken along section lines 5—5 in FIG. 3. As described above, embossing tool 40 is preferably formed of a molded plastic material or the like and includes a pair of generally planar jaw portions 41 and 42 resiliently coupled by a hinge portion 43. Also, in its preferred form, embossing tool 40 is fabricated of a somewhat resilient plastic material or the like which facilitates the creation of a resilient hinge at hinge 43 providing a natural opening or resilient spring force which tends to urge jaws 41 and 42 apart toward the position shown in FIG. 2 in the absence of a closing force. As is also described above, jaw 41 defines a planar surface 44 having an extending raised portion 45. Jaw 42 defines a planar surface 46 having a recess 47 formed therein. Raised portion 45 and recess 47 are positioned upon surfaces 44 and 46 respectively such that raised portion 45 is aligned with and centered with respect to recess 47 when jaws 41 and 42 are brought to closure. As a result, with jaws 41 and 42 brought to the closed position shown in FIG. 5, raised portion 45 is received at least partially within recess 47.

In further accordance with the present invention, a portion of skirt 22 is positioned between jaws 41 and 42 of embossing tool 40. In its preferred form, skirt 22 comprises a plurality of material layers combined or bound together using a suitable adhesive or other bonding process. Thus, in its preferred form, skirt 22 comprises a pair of fabric or cloth layers 50 and 52 secured to a common malleable foil layer 51. Fabric layers 50 and 52 may, for example, comprise a flexible cloth material while foil layer 51 may comprise a malleable metal foil such as conventional aluminum foil or the like. Alternatively, it will be recognized that a variety of soft flexible materials may be used to form fabric layers 50 and 52 such as synthetic fabric materials or pressed paper or the like to provide the desired appearance and texture for skirt 22. Correspondingly, other malleable or formable materials may be utilized to form foil layer 51 having the essential property of malleability or easy formability to provide the embossing retention required by the present invention. In its preferred form, however, skirt 22 utilizes a cloth or similar fabric for layers 50 and 52 to provide a colorful and suitably textured appearance for skirt 22.

As can seen in FIG. 5, the closure of embossing tool 40 upon an intermediate portion of skirt 22 forms layers 50, 51 and 52 in a shape corresponding to raised portion 45 and recess 47. The material of skirt 22 readily forms when subjected to the embossing pressure of raised portion 45 into recess 47 due to the flexibility of fabric layers 50 and 52 and the malleability of foil layer 51. Once embossing tool 40 is released and removed from skirt 22, the malleable character of foil layer 51 retains the shape imposed thereupon by raised portion 45 and recess 47. The malleable character of foil layer 51 is sufficient to maintain flexible layers 50 and 52 in the embossed shape and thus an embossed design is imposed upon and remains embossed upon skirt 22.

Figure 6:
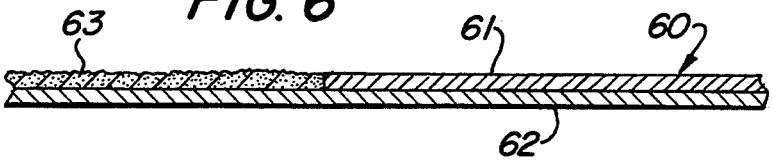
FIG. 6 sets forth a section view of an alternate embodiment of the embossible fabric of the present invention.

FIG. 6 sets forth a section view of an alternate embodiment embossible fabric constructed in accordance with the present invention and generally referenced by numeral 60. Embossible fabric 60 utilizes a soft layer 61 and a malleable material layer 62 bonded together forming a composite fabric material. Embossible fabric 60 may be formed utilizing conventional adhesive or other bonding techniques and is utilized in the above-described manner set forth to provide an embossible reusable material in combination with an embossing tool such as embossing tool 40. In its preferred form, foil layer 62 is fabricated of a malleable metal foil such as conventional aluminum foil. However, it will be apparent to those skilled in the art that virtually any thin malleable foil or thin malleable material may be used to form layer 62. Similarly, soft layer 61 is preferably fabricated of a woven cloth or other synthetic material having a soft flexible character. However, it will be apparent to those skilled in the art that soft layer 61 may be formed of other materials such as pressed paper or other cellulose material having the essential character of a relatively soft flexible material. By way of further alternative, soft layer 61 may be formed of a deposited material such as deposited material 63 which is formed upon malleable layer 62 using a conventional depositing process such as spraying or the like to provide a soft flexible covering for malleable layer 62. Thus, layer 63 may, for example, comprise a deposited adhesively bound layer of soft material such as particulate paper or the like to provide the desired surface texture.

Thus, in accordance with the present invention, the child user is able to emboss a plurality of raised or recessed designs at the desired portions of the fabric material worn by or associated with the present invention doll. In further accordance with the present invention, the child user is able to restore the fabric material to its original nonembossed shape by simple smoothing of the fabric material and thereafter repeat the embossing process. The embossing and smoothing may be carried forward in repeated play patterns and thus permits the child user to enjoy a variety of embossing configurations. In addition, the variety of embossing shapes and sizes to be used is virtually unlimited and may include embossed designs such as hearts, diamonds, stars or the like, various names and symbols such as the child user's name or, alternatively, various pleating and crimping shapes such as corrugation or the like.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in combination with a doll having a body to which clothing or accessories may be secured, apparatus comprising:

an embossible article securable to said body and having a malleable layer and at least one flexible layer commonly joined to form a composite material; and an embossing tool having mating portions for embossing a predetermined design upon said embossible article, said embossing tool forming embossed designs upon said embossible article which remain after said embossing tool is removed and said embossible article being capable of return to original nonembossed condition by manually smoothing out said design.

2. Apparatus as set forth in claim 1 wherein said malleable layer is formed of metal foil.

3. Apparatus as set forth in claim 2 wherein said at least one flexible layer is formed of cloth.

4. Apparatus as set forth in claim 3 wherein said embossible article forms a portion of an apparel article.

5. Apparatus as set forth in claim 4 wherein said embossing tool mating portions include a raised portion and a recessed portion having a shape corresponding to said raised portion and slightly greater in size than said raised portion.

6. Apparatus as set forth in claim 2 wherein said at least one flexible layer is formed of soft particulate material deposited upon said malleable layer.

7. A toy comprising:

a doll having a body for receiving and supporting apparel articles;

an apparel article having an embossible portion defining a malleable characteristic; and an embossing tool having mating portions for imposing an embossed design upon said embossible portion of said apparel article, said apparel article being capable of smoothing to remove said embossed design.

8. A toy as set forth in claim 7 wherein said embossible portion of said apparel article includes a malleable layer and a first soft flexible layer joined to form a composite fabric.

9. A toy as set forth in claim 8 wherein said embossible portion of said apparel article further includes a second soft flexible layer and wherein said malleable layer defines opposite sides to which said first and second soft flexible layers are joined.

10. A toy as set forth in claim 9 wherein said malleable layer is formed of metal foil.

11. A toy as set forth in claim 10 wherein said first and second soft flexible layers are formed of cloth.

12. For use in combination with a doll, the combination comprising:

a fabric article including at least one layer of malleable foil and at least one layer of substantially less malleable flexible material securable to said doll and having an embossible portion capable of being formed and smoothed repeatedly; and an embossing tool for forming an embossed design upon said embossible portion.

13. The combination set forth in claim 12 wherein said malleable foil is a metal foil and wherein said flexible material is cloth.

14. The combination set forth in claim 12 wherein said malleable foil is a metal foil and wherein said flexible material is particulate material bonded to said foil.

15. The combination set forth in claim 12 wherein said malleable foil is a metal foil and wherein said flexible material is a color pigmented material.

* * * * *